US006072141A

United States Patent [19]

Slamecka

[11] Patent Number: 6,072,141

[45] Date of Patent: Jun. 6, 2000

[54] VACUUM SWITCH CONTACT ARRANGEMENT

[76] Inventor: Ernst Slamecka, Alt-Pichelsdorf 13, D-13595 Berlin, Germany

[21] Appl. No.: 08/809,568

[22] PCT Filed: Sep. 8, 1995

[86] PCT No.: PCT/DE95/01272

§ 371 Date: Jun. 23, 1997

§ 102(e) Date: Jun. 23, 1997

[87] PCT Pub. No.: WO96/09637

PCT Pub. Date: Mar. 28, 1996

[30] Foreign Application Priority Data

| | | | |
|---|---|---|---|
| Sep. 22, 1994 | [DE] | Germany | 44 35 372 |
| May 12, 1995 | [DE] | Germany | 195 18 233 |
| May 18, 1995 | [DE] | Germany | 195 19 077 |
| Jun. 11, 1995 | [DE] | Germany | 195 21 948 |

[51] Int. Cl.[7] ..... H01H 33/66

[52] U.S. Cl. ..... 218/127; 218/123; 218/128

[58] Field of Search ..... 218/127, 128, 218/129, 123

[56] References Cited

U.S. PATENT DOCUMENTS

| | | | |
|---|---|---|---|
| 3,764,764 | 10/1973 | Takasuna et al. . | |
| 4,210,790 | 7/1980 | Kurosawa et al. | 200/144 B |
| 4,293,748 | 10/1981 | Sakuma et al. | 200/144 B |
| 4,445,015 | 4/1984 | Zueckler | 200/144 B |
| 4,698,467 | 10/1987 | Kaneko et al. | 200/144 B |
| 4,704,506 | 11/1987 | Kurosawa et al. . | |
| 5,055,639 | 10/1991 | Schels et al. | 200/144 B |
| 5,099,093 | 3/1992 | Schels et al. | 200/144 B |

FOREIGN PATENT DOCUMENTS

| | | |
|---|---|---|
| 0133368 | 2/1985 | European Pat. Off. . |
| 0203367 | 4/1986 | European Pat. Off. . |
| 2520927 | 8/1983 | France . |
| 2431224 | 9/1976 | Germany . |
| 2734646 | 2/1978 | Germany . |
| 3227482A1 | 2/1983 | Germany . |
| 3415744A1 | 10/1985 | Germany . |
| 3519449 | 1/1986 | Germany . |
| 3519449A1 | 1/1986 | Germany . |
| 3435637A1 | 4/1986 | Germany . |
| 3728400C1 | 3/1989 | Germany . |
| 4117606A1 | 10/1991 | Germany . |
| 4002933C2 | 1/1993 | Germany . |
| 4414632A1 | 10/1994 | Germany . |

OTHER PUBLICATIONS

Kaneko, E. Tamagawa, T. et al., "Recent Investigations and Developments of Vacuum Circuit Breakers in Japan", *e&i*, 107Jg., 1990, H.3, pp. 127–133.

*Primary Examiner*—Ronald Stright
*Assistant Examiner*—Michael J. Hayes
*Attorney, Agent, or Firm*—Venable; George H. Spencer; Catherine M. Voorhees

[57] ABSTRACT

A vacuum circuit-breaker contact arrangement includes a pair of contacts each being relatively axially movable from a position of engagement to a position of disengagement to establish a circuit interrupting arc therebetween, at least one of said contacts being provided with a generally cup shaped member having a base portion and a wall portion, a plurality of slots which produce winding sections being arranged in said cup shaped member, the inside of the cup shaped member being at least partly covered by a contact- and electrode-member mounted at a front side of the cup shaped member and facing the other contact, the other contact having a contact- and arc-carrying-member generally aligned with the contact- and electrode-member of the at least one contact, wherein the plurality of slots includes at least one first slot and a second slot, the base portion of at least one contact being provided with at least one first slot which essentially extends along a part of a circle and penetrates at least partly the base portion, the second slot being joined to an end of said first slot and extending at least into the wall portion of the cup shaped member toward the contact- and electrode-member, so that radially outside of the first slot is produced at least one winding section which generates an essentially axial magnetic field in a current conducting state.

5 Claims, 16 Drawing Sheets

VACUUM SWITCH CONTACT ARRANGEMENT

BACKGROUND OF THE INVENTION

The present invention relates to a structure of contacts for use in vacuum type circuit-breakers generating in the current carrying state on axial magnetic field for the interruption of an arc when established between the separating contacts during an opening operation of the vacuum circuit-breaker. In the closed state of the vacuum circuit-breaker the contacts carry currents of different values under specified conditions.

DESCRIPTION OF THE PRIOR ART

A contact arrangement of the presupposed type is known from DE 32 27 482 A1. In this case, inclined gaps in the wall part of the cup-shaped contact makers generate winding elements that are inclined toward the contact maker axis, and these winding elements generate an axial magnetic field when current flows through them. The gaps in the wall part can continue in the bottom part of the contact maker. The disadvantage of this contact arrangement lies in the slant for the winding elements, because only their azimuthal components contribute to generating the axial magnetic field when current flows through.

Another contact arrangement of the presupposed type is described in EP 0 133 368 A3. In this case as well, axially inclined gaps are arranged in the wall part of a cup-shaped contact maker, which continues in the same plane in the bottom part. The gap region in the bottom part follows the course of a chord. With this gap arrangement, the current flows in the contact maker arc to receive a considerable tangential component, so that an electric arc developing between the opening contacts is caused to rotate immediately on the front of the wall part. Thus, a radial magnetic field is obviously generated in the gap length by two axially facing contact makers. This does not contribute to an improved generating of an axial magnetic field.

SUMMARY OF THE INVENTION

It is the object of the invention to create a winding arrange ent with considerably higher efficiency for generating an axial magnetic field, as compared to the Prior Art, so that a contact arrangement thus equipped will achieve a considerably higher short-circuit breaking power.

The invention is based on the realization that with the known contact arrangements that generate a magnetic field, the cup shape used is utilized only in part for forming ring-segment shaped winding elements. In the sequence of the ideas, the essential part of the invention consists first using the cup bottom and then, if necessary, also the cup wall as support for ring-segment shaped winding elements. Partial ring-shaped gaps arranged in the cup bottom are used for this. Second gaps adjoin the ends of the first winding-producing first gaps that run in the bottom which limit the winding elements in azimuthal direction while running in the cup wall essentially facing the contact and electrodes.

BRIEF DESCRIPTION OF THE DRAWINGS

The invention is explained below in more detail with the aid of drawings of exemplary embodiments in FIGS. 1 to 38 in which.

DETAILED DESCRIPTION OF THE INVENTION

The contacts I, II, III in FIGS. 1 to 12 each represent one of a pair of contacts, which can be moved relative to each other and essentially axially and which are installed in a non-depicted vacuum switching tube. These two contacts are composed of identical components and face each other axially aligned, but not in a mirror—inverted arrangement. Each, of the three contact embodiments I, II, III is shown in respectively two different views or from above, wherein the same components are generally described only once.

Figure 2:
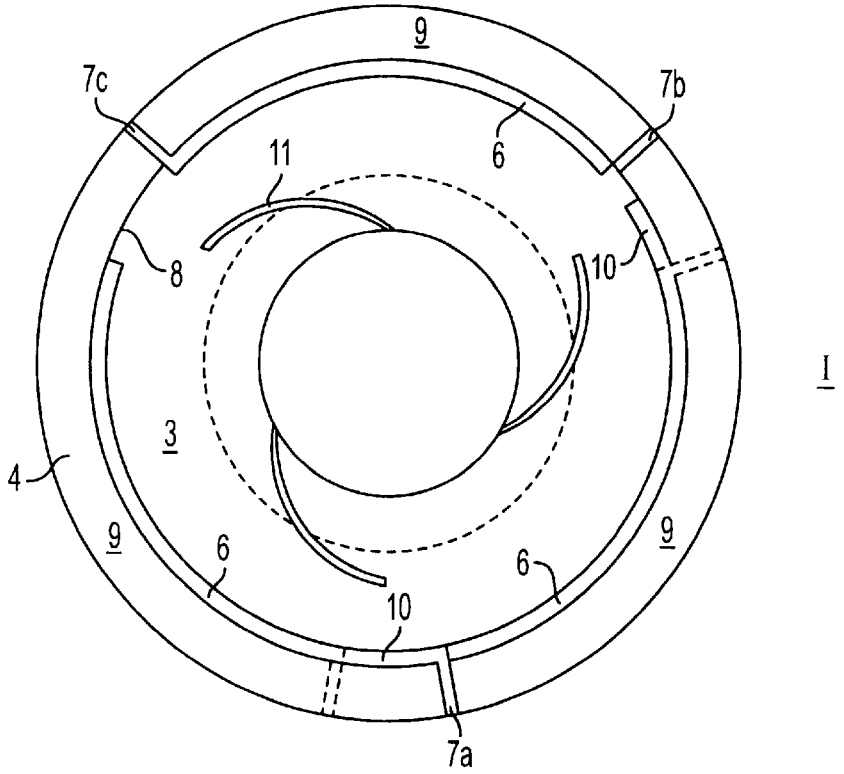
FIG. 2 is a plan view of the contact according to FIG. 1, without contact disk.
Figure 1:
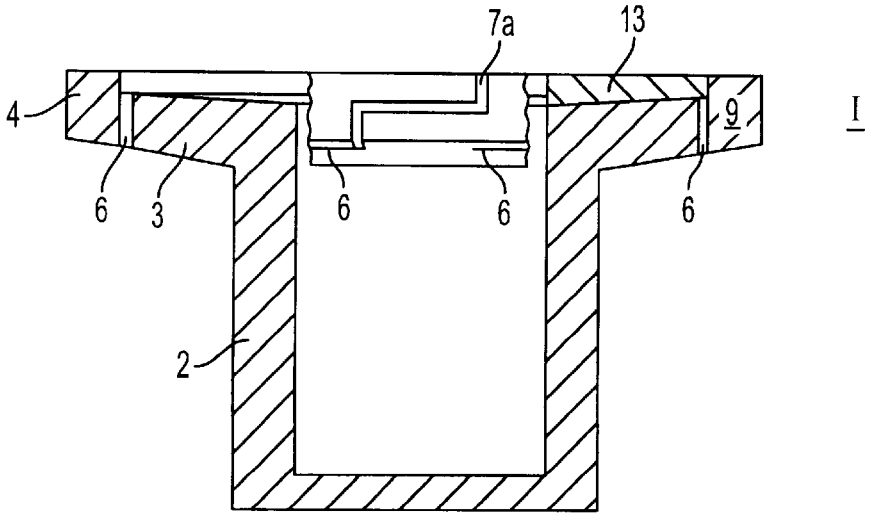
FIG. 1 is a longitudinal sectional view of a contact, showing a radial, graduated radial cup-wall gap or one that runs along a screw-type cutting surface.

The power connector or contact rod 2, FIG. 1, is designed as a hollow-cylindrical element that is closed on one side. Positioned on its front and facing the contact-break distance is the basically cup-shaped bottom part 3 of contact I. The bottom part is shaped like a flat truncated cone standing on its head This part can also have the shape of an annular disk and a fully cylindrical bolt care also be used for the power connector or contact rod. A cylindrical wall part 4 adjoins the bottom part 3. Power connector or contact rod 2, bottom part 3 and wail part 4 can represent individual parts that arc combined to form the cup-shaped contact. However, these individual components can also be integrated components of a contact that is produced as one piece, e.g., with the molding method, which is the case for the exemplary embodiment An annular disk-shaped contact and electrode element 5, FIGS. 3, 4, rests on the free edge of wall part 4. This disk is composed of a metal compound containing at least chromium and copper. The generally disk-shaped contact and electrode element 5 at the contact I as well as at the contacts II and III, which are still to be described, call be composed in a way not shown here of two single disks, each made of materials with different electrical conductivity. In this case, the single disk of a material with high electrical conductivity, e.g., OFHC copper, forms the base that is attached to the edge of the wall part 4, e.g., by soldering it. The considerably thinner, second disk of a material with relatively small electrical conductivity, e.g., composed of a metal compound with a high percentage chromium, is soldered or welded onto this base over a large surface area. The second disk can also be produced, for example, by coating the base disk with chromium. The resultant body and power connector or contact rod 2 are made of an electrically high-conductive copper, which also holds true for the cup bodies and power connectors of contact embodiments II and III. In order to produce the winding sections 9, three rotational-symmetrically distributed first gaps or slots 6 are arranged along the inside of the wall part 4, which penetrate the bottom part 3 and have cylindrical side surfaces, as shown in FIG. 2. This results in a projection 8 in the bottom part 3, respectively between two first gaps, from which one each winding section 9 starts, wherein it is limited by a second gap or slot 7 that adjoins the end of a first gap. The side surfaces of the first gap 6 can also be inclined toward the contact axis and can generally extend conically inward or outward. A design with a smaller or larger number of first gaps per contact, for example two or six, is possible as well. The first gaps 6 can also maintain a certain radial distance to the inside wall of the wall part 4.

The second gaps 7 extend to thc front edge of the wall part 4, but can also end before it in a way not shown here. Initially they are shown in three design variants 7*a*, 7*b*, 7*c*. The second gap 7*a* progresses in a first radial plane until just below the surface of the cup bottom part 3. The gap 7*a* then turns approximately at a right angle and runs azimuthally along the projection 8, only to continue finally in a second radial plane until it reaches the underside of the bottom part 3. In the view of the cup wall part 4, this type of second gap is shown as a resting Z. Accordingly, the end of the coordinated winding section 9 overlaps the bottom projection 8. In the case at hand, it is still necessary to separate the winding end from the projection 8 by a distancing gap or groove 10 along the inside of the wall part that is close to the winding end; FIG. 2.

For the winding section 9, FIG. 2, on the upper right in FIG. 2, the second gap 7*b* runs along a screw surface in the wall part 4,. This surface can be produced by a straight line that rotates with approximately constant pitch, wherein it intersects the contact axis at a right angle. The straight line producing this can also intersect the contact axis at a slanted angle. The second gap 7*b* can also run along a plane that is inclined toward the contact axis and which intersects the front edge of the wall part with a radial track, which is not shown here. Owing to the relatively short azimuthal extension of the wall part in the region of the bottom projection 8 and thus also the short length of the generally inclined gaps 7*b* in wall part 4, these gap shapes differ structurally and only insignificantly from each other. On this case as well, it is necessary to limit the overlapping winding end through a distancing gap or groove 10 in the region of projection 8 where the slanted second gap or slot 7*b* runs below thc inside surface of the bottom part 3.

The second gap 7*c*, shown on the upper left in FIG. 2, is a current-conducting gap that runs in a radial plane. Accordingly, an overlapping of the end of the winding section 9 with the bottom projection 8 does not occur, so that a gap appears in the magnetization. This can be compensated for at least in part by third gaps or slots 11 in the bottom part, FIG. 2. These gaps originate from or from near the inside edge of the bottom part 3 or the hollow-cylindrical power connector or contact rod 2 and approach with increasing length toward the wall part 4. As a result of this, the flow in the bottom part has an increasingly azimuthal and thus axially magnetizing course. The eddy currents in the bottom part are also dampened at the same time. Another option, which is not shown, for at least partially compensating for the magnetizing if sections 9 do not overlap consists of assigning the stationary contact and the movable contact azimuthally to each other as follows: A radial gap 7*c* and an adjoining bottom projection 8 on one contact are located opposite the region of the winding section 9 on the other contact.

Figure 4:
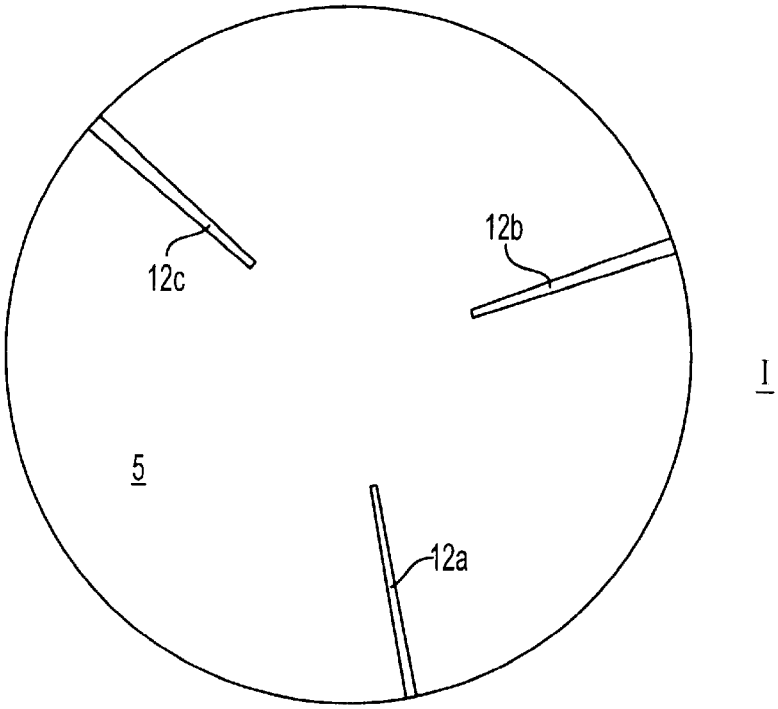
FIG. 4 is a plan view of the contact according to FIG. 3.
Figure 3:
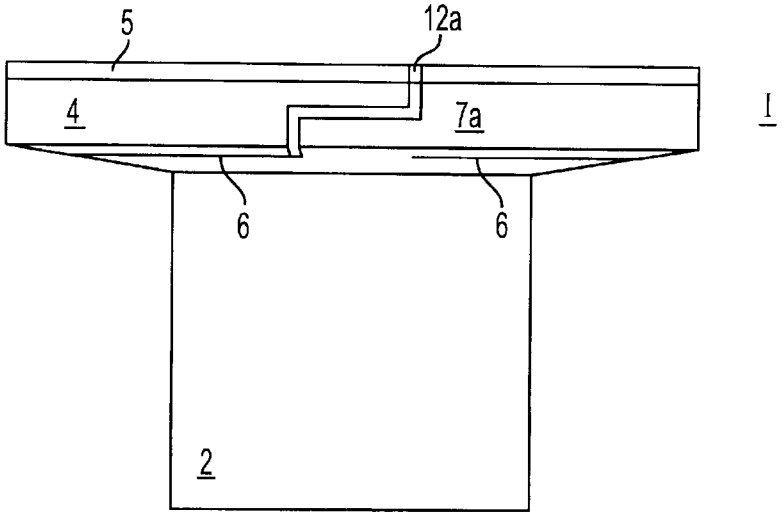
FIG. 3 is an elevational view of the complete contact according to FIG. 1.

In order to dampen the eddy currents in the contact arid electrode disc 5, radial gaps or slots 12, for example, can be arranged therein, see FIGS. 3, 4. If these gaps are also aligned with the second gaps 7*a*, 7*b*, 7*c* in the wall part 4, they also prevent direct current flow between the adjacent end and the beginning of two neighboring winding sections that are applied with a different potential. The potential difference increases with the length of the winding sections. With four, five or six winding sections per contact and/or with small contact diameters, the winding lengths are already considerably shorter and accordingly, the potential differences are smaller. That is why it is possible to select in these cases another type of partial covering for the inside space of the cup-shaped contact, e.g., by using a non-depicted ring-shaped disk-type contact and electrode element. A supporting element 13 of a material with at most poor electrical conductivity can be arranged in the space between the bottom part and the contact and electrode element. In the exemplary embodiment at hand, this element has the approximate shape of a ring-shaped disk, for which the inside diameter is the same as the inside diameter for the hollow-cylindrical power connector or contact rod 2; FIG. 1. Also, it is possible to provide at least for a partial interruption in the cohesiveness of the supporting element for the purpose of saving weight.

Figure 6:
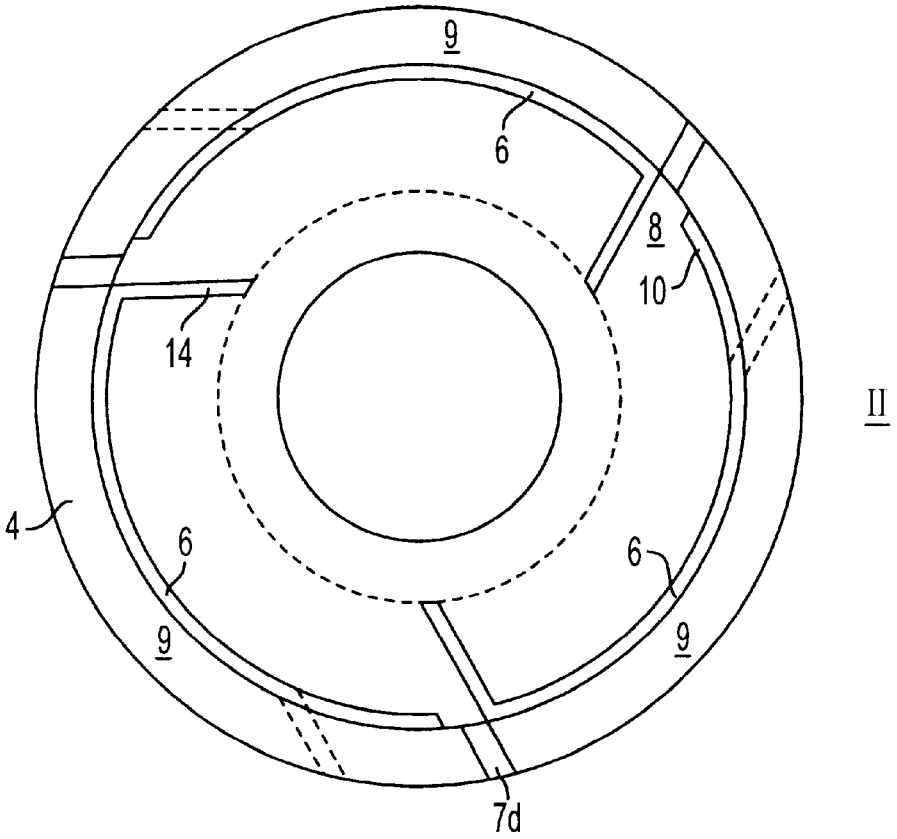
FIG. 6 is a plan view of the contact according to FIG. 5, without contact disk.
Figure 5:
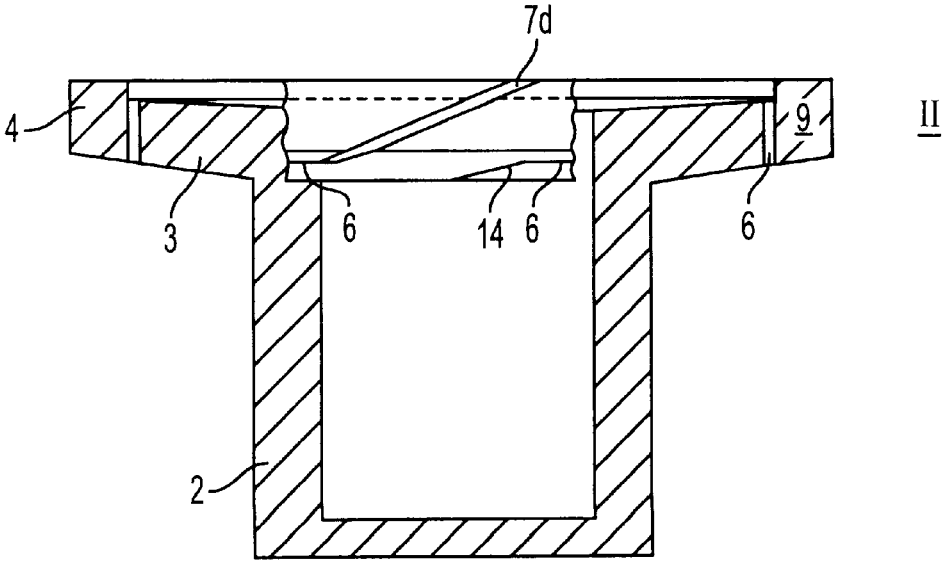
FIG. 5 is a longitudinal sectional view of a contact with slots in the wall portion inclined toward the contact axis.
Figure 8:
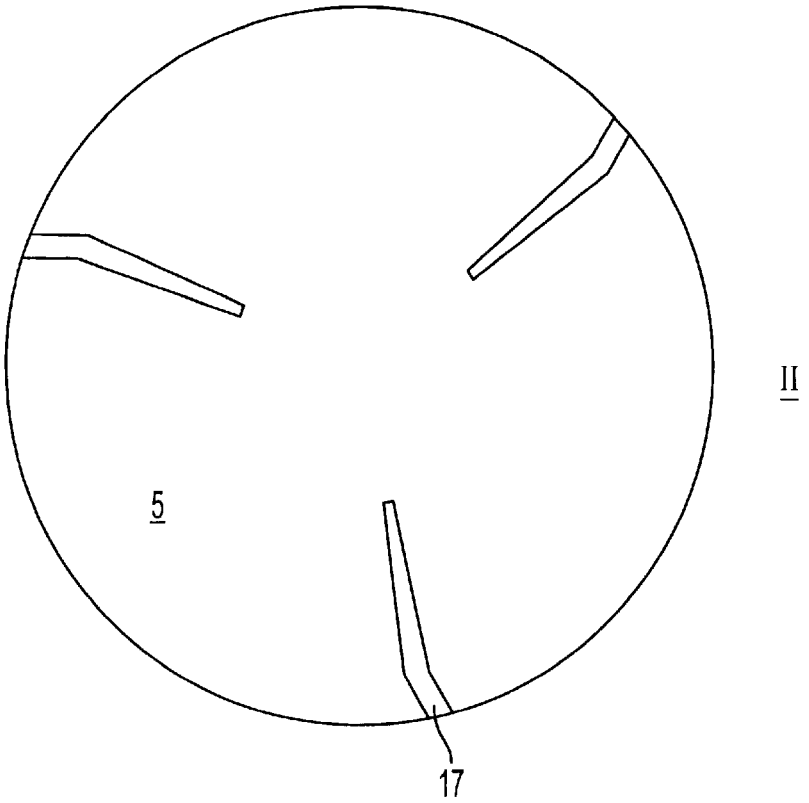
FIG. 8 is a plan view of the contact according to FIG. 7.
Figure 7:
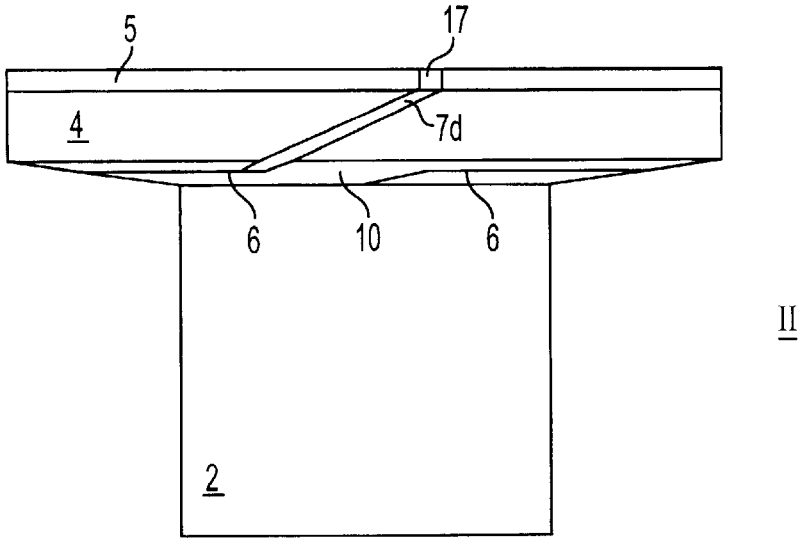
FIG. 7 is an elevational view of the complete contact according to FIG. 5.

The second gap or slot 7*d* in the contact II shown in FIGS. 5, 6 is produced by a cut inclined toward the contact axis at an obtuse angle, thus extending chord-like in the bottom part 3. The current flowing from the power connector or contact rod 2 via the bottom part 3 toward projections 8 and to the winding sections 9 is favorably influenced or guided by current conducting gaps, third gaps 14. These gaps adjoin the free beginnings of the first gaps or slots 6 and, as segments of chords, follow courses that turn away from the first gaps 6. In comparison to FIG. 1, the supporting element for the contact and electrode element is omitted in FIG. 5. The contact and electrode element 5 in FIGS. 7, 8 has three rotation-symmetrically arranged gaps 17, which starting with the outside edge of the contact and electrode element 5 and above the edge of the wall part 4 are aligned with the second gaps or slots 7*d* and are radially aligned for the further course. The winding sections produced by the plurality of gaps or slots follow each other in turn as in FIG. 6.

Figure 10:
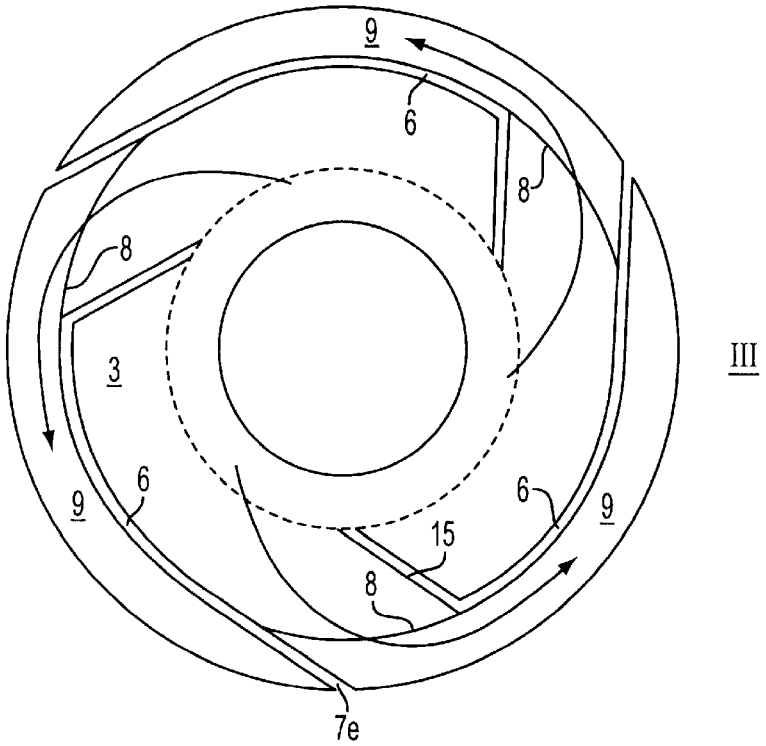
FIG. 10 is a plan view of the contact according to FIG. 9.
Figure 9:
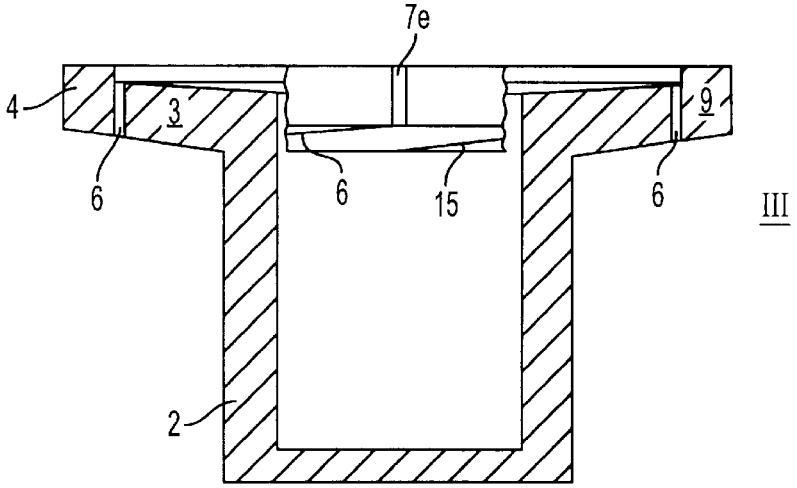
FIG. 9 is a longitudinal sectional view of a contact with tangential cup wall gaps.
Figure 12:
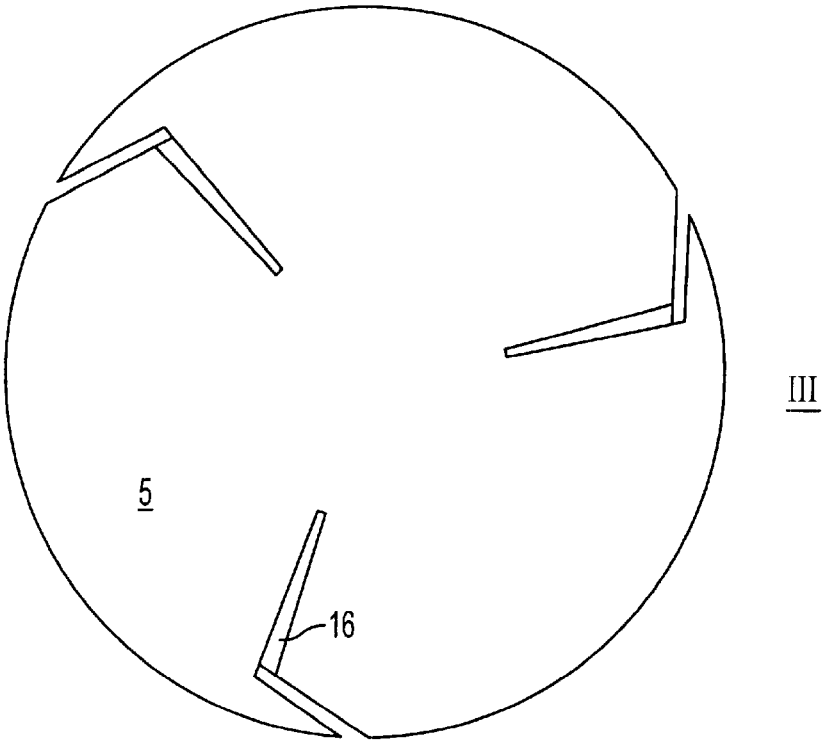
FIG. 12 is a plan view of the contact according to FIG. 11.
Figure 11:
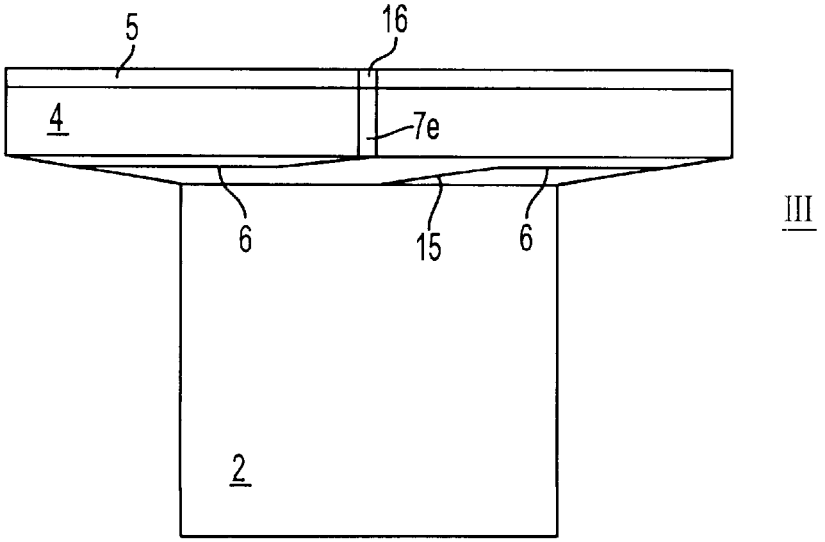
FIG. 11 is an elevational view of the complete contact according to FIG. 9.

The second gaps or slots 7*e* of contact III in FIGS. 9, 10 have tangential connection to the first gaps 6. The cutting planes that produce these gaps extend essentially parallel to the contact axis. An overlapping of winding section 9 and bottom projection 8 therefore occurs laterally. The current flow from the bottom projections 8 toward the winding sections 9, coming from the contact rod 2 via the bottom part 3, is influenced favorably by third gaps or slots 15 in the bottom part; FIG. 10. These gaps 15, which are arranged rotation-symmetrical and adjoin the beginnings of the gaps 6 and run approximately parallel to the second gaps 7*e*, conduct the current from the power connector or contact rod 2 via an approximately spiral intermediate phase in the bottom part 3 into the circular phase for the winding sections 9, which is indicated by flow arrows, If the third gaps 15 extend to the inside edge of the power connector or contact rod 2, they also dampen the eddy currents in its front region. Three gaps 16 are arranged rotation-symmetrical in the contact and electrode element 5 shown in FIGS. 11, 12, which have the typical curve already described with the aid of FIG. 8.

Figure 38:
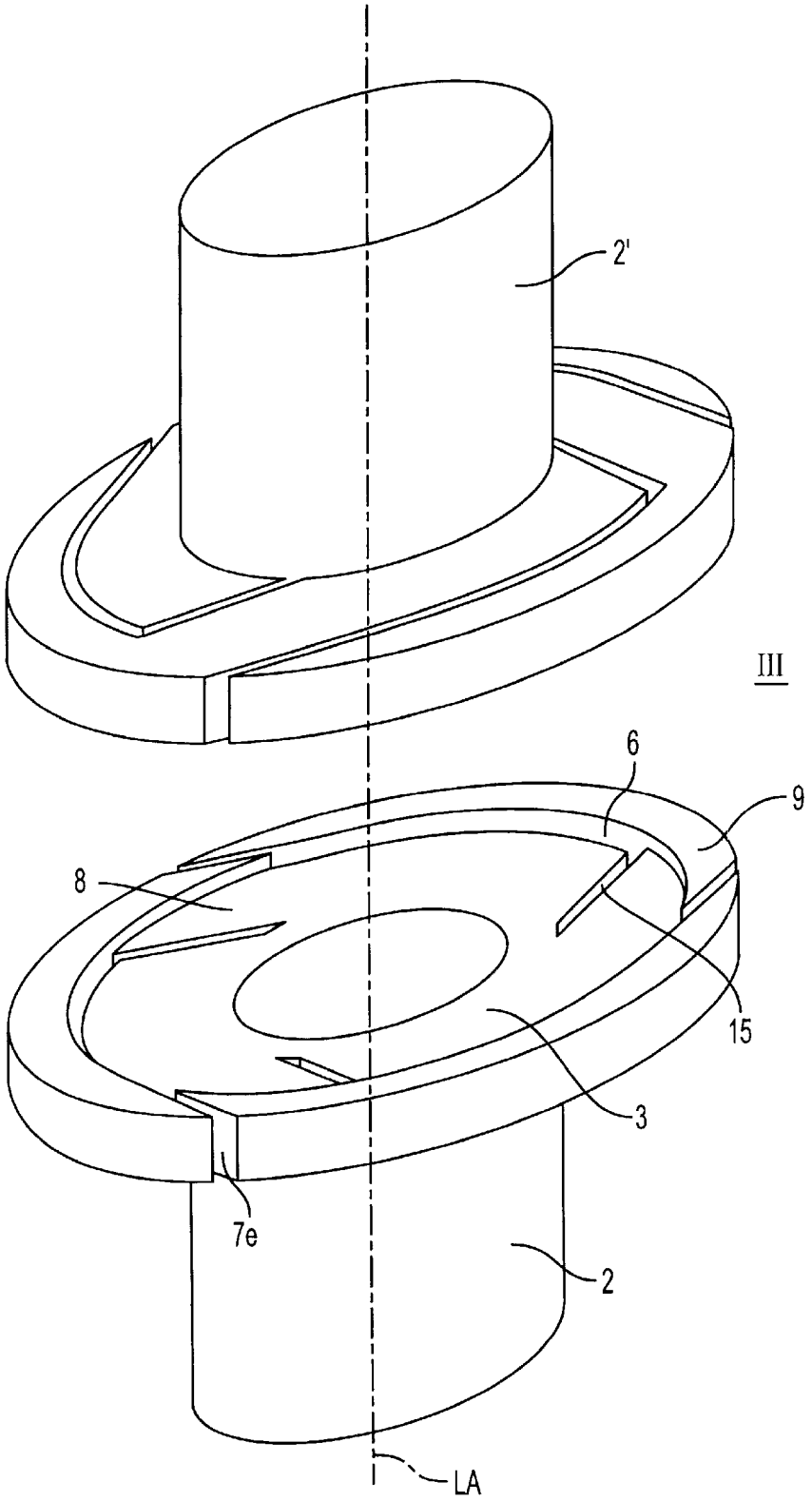
FIG. 38 is a perspective view of two contacts according to FIGS. 9 and 10 facing each other along a contact axis LA.

The winding sections 9 or 9' of the facing, contact arrangements (see FIG. 38) are arranged at contacts I, II, III on the one hand and I', II', III' on the other hand—the latter are not shown—which are aligned approximately axially facing, in such a way that they have the same winding direction. Thus, each winding arrangement generates for itself one each axial, magnetic field with the same direction, i.e., a unipolar magnetic field. The winding elements 9 and 9' can be arranged at the contacts I, II, III or I', II', III', even with opposite winding direction relative to each other, so that two axial magnetic fields with opposite direction are generated.

Figure 15:
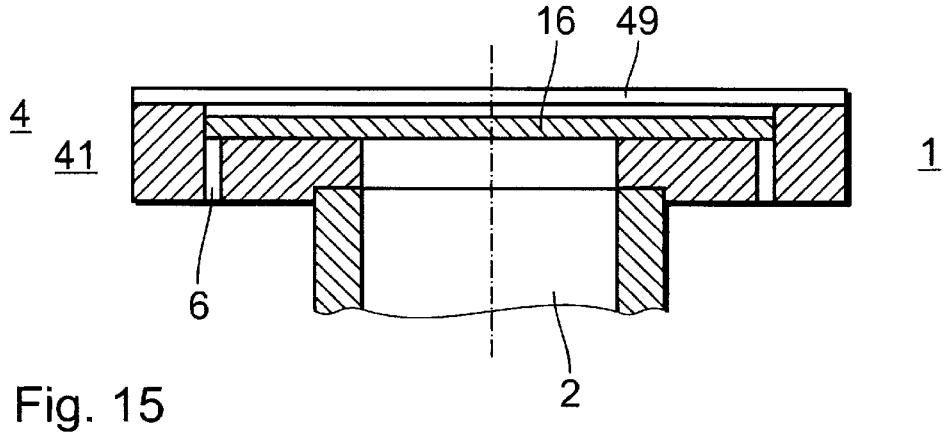
FIG. 15 is a partial sectional view A—A of the contact according to FIG. 14, with contact and electrode element as well as supporting elements.
Figure 14:
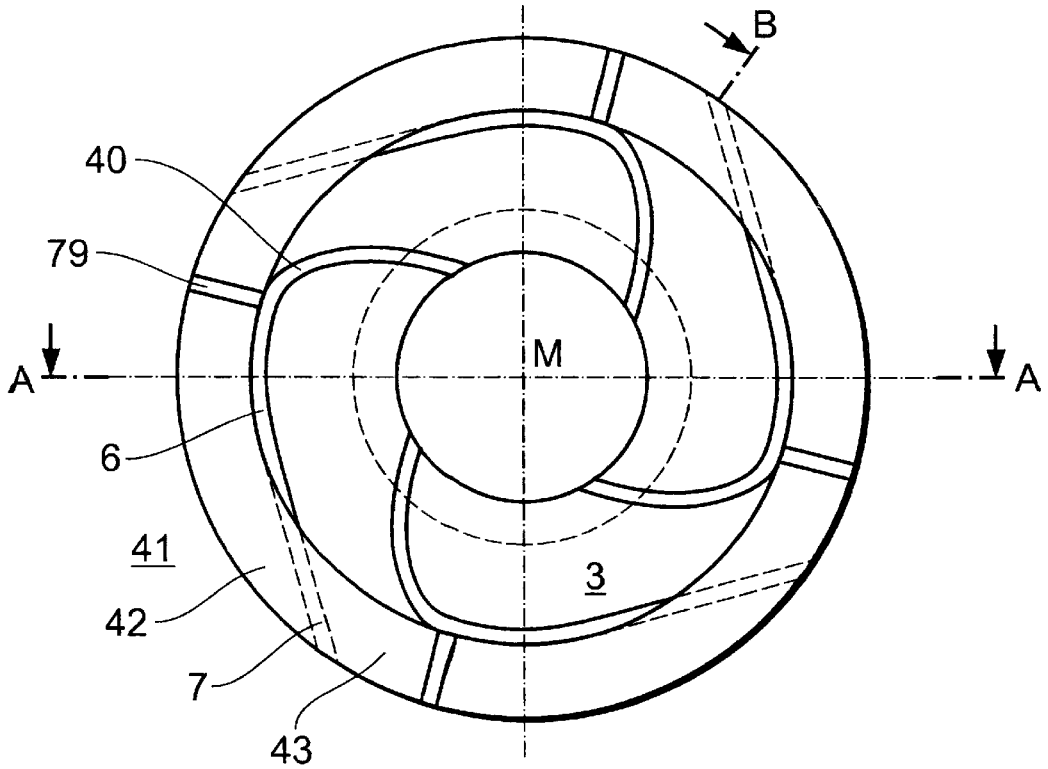
FIG. 14 is a plan view of the contact according to FIG. 13.
Figure 13:
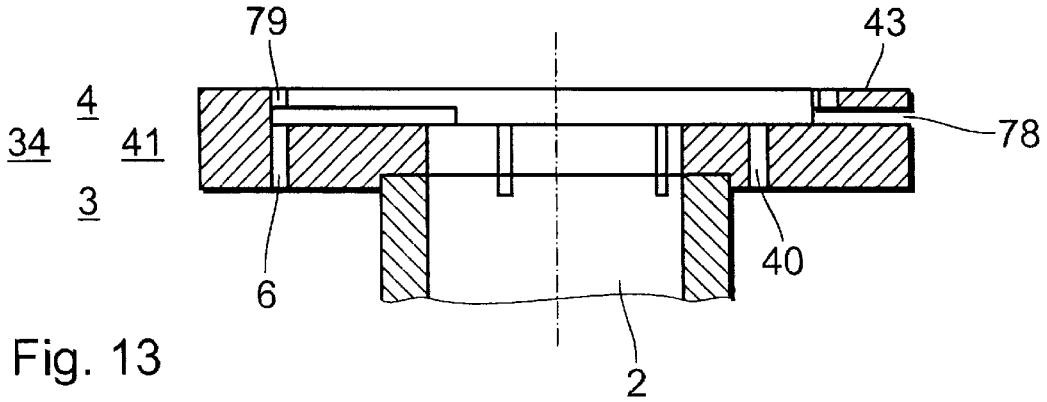
FIG. 13 is a partial sectional view of a contact with the contact and electrode element removed; left of center; cut A-M according to FIG. 14; circular arc shaped gaps or slots in the cup bottom with axis-parallel side surfaces; gaps or slots in the cup wall that adjoin the circular gaps tangentially; right of center; cut B-M.
Figure 17:
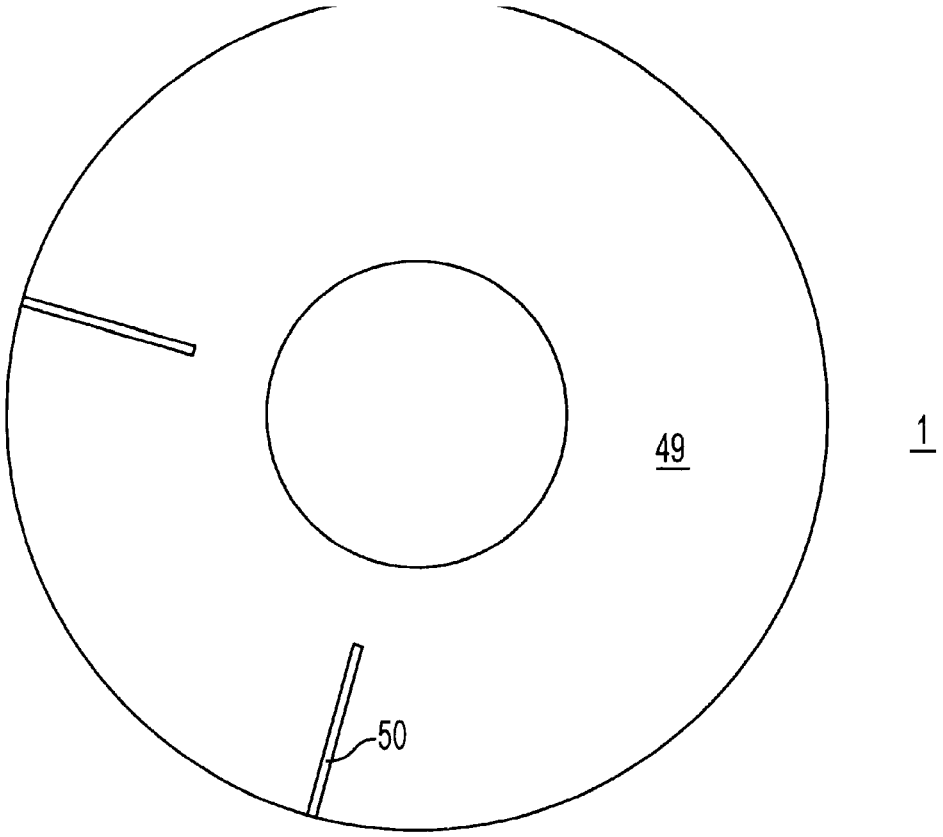
FIG. 17 is a plan view of the contact according to FIG. 16.
Figure 16:
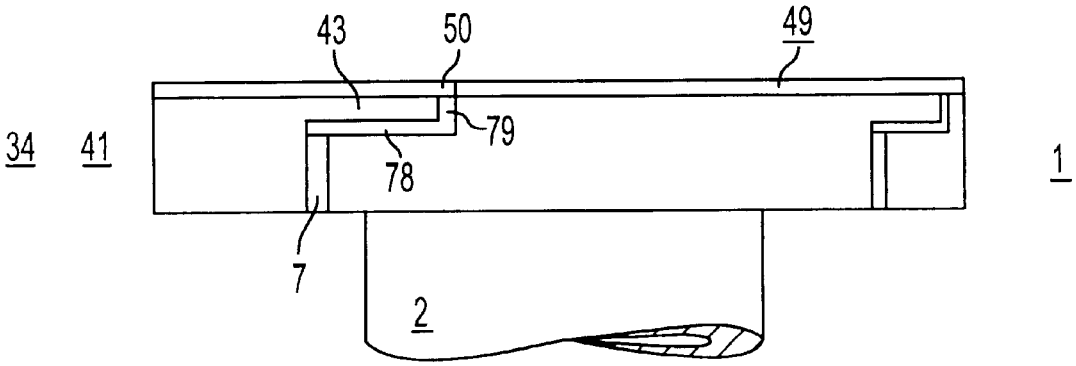
FIG. 16 is a partial elevational view of the contact according to FIG. 15.

The first gap or slot 6 in the cup bottom 3 of the cup-shaped support 34 of the contact- and electrode element as well as winding sections of the contact 1 is joined approximately tangentially by a second gap or slot 7, FIGS. 13, 14, and 15. The second gap in the cup wall 4 does not extend to its frontal surface, but only far enough so that a third gap 78 can adjoin this gap in the wall part. This gap 78 then extends above the cup bottom until just before the preceding first slot or gap 6; FIG. 14. There, a fourth gap 79 follows, which runs to the front of the cup wall and penetrates it radially. The transition from the cup bottom to the cup wall front thus occurs in one stage; FIG. 16. However, the gap 79 can also be inclined toward the contact axis, so that a ramp-shaped transition takes place, which is not shown. Along the second gap 7 that tangentially adjoins the first gap 6, there is a peripheral overlapping of the exit region for the preceding winding section 41 through the region 42 of the following winding section 41. Following the peripheral overlapping, this exiting region is also overlapped axially by the azimuthal extension 43 of the following winding section 43; FIGS. 13, 14. The winding sections produced by the plurality of slots or gaps follow each other in the same order of turn as shown in FIG. 13. A ring-shaped contact and electrode element 49 is positioned on the cup-shaped support 34 of contact 1; FIGS. 15, 16, 17. The contact and electrode element or disk 49 can have radial gaps 50, which is true for one half of the disk FIG. 17. This disk can also be designed without gaps if necessary—the specific electrical conductivity of the disk material is then considerably smaller relative to that of copper—as can be seen in the other disk half in FIG. 17. The contact and electrode element or disk is supported by an essentially also disk-shaped supporting element 16, shown in FIG. 15, which extends to at least a partial region of the gap 78; FIG. 13. The circular disk supporting element 16 can also be designed as ring-shaped disk, which is not shown further.

Figure 19:
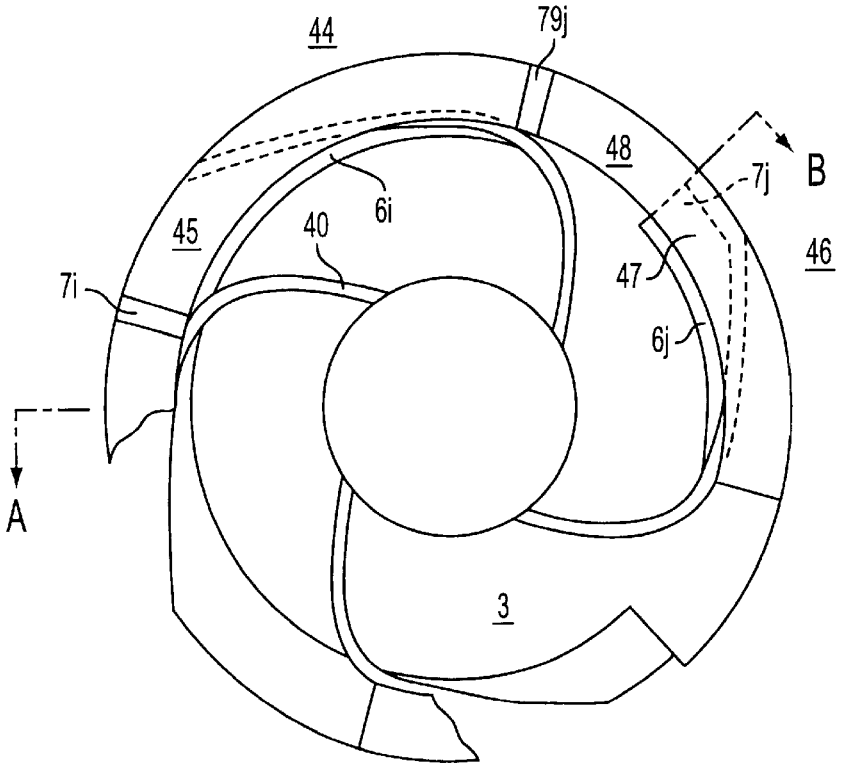
FIG. 19 is a plan view of contact according to FIG. 18; left of center; according to FIG. 18; left of center; right of center; according to FIG. 18, right of center.
Figure 21:
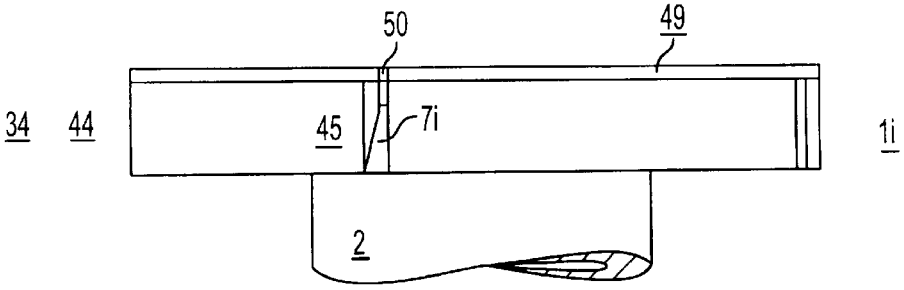
FIG. 21 is a partial elevational view of contact according to FIG. 20; right of center.

Concerning the gap design 6*i* as shown in FIG. 19: the peripheral side surfaces of the first gap 6*i* that are inclined toward the contact axis are extended, starting with one of its ends—or after it—with increasing inclination, such that the inside peripheral surface initially reaches the bottom edge and then extends with constant inclination toward the preceding first gap; left half of view from above in FIG. 19. With this guidance of the first gap in the cup bottom, the intersecting line of the cup wall inside with the inside surface of the cup bottom serves as guiding edge for a milling cutter. A second gap 7*i* adjoins the free end of the first gap and extends axially to the frontal surface of the cup wall, which it penetrates radially; FIG. 19, left half of view from above of FIG. 21. This results in a winding section 44 with a twice overlapping winding region 45; FIG. 19, left half of view from above. In the lower fourth of the illustration, the winding section 44 is for the most part broken off, so that the peripheral side surface located on the inside for the first gap 6*i* is visible. For a variant, the region of the dual overlapping in the same location is designed with constant inclination via a longer arc length for the first gap The current flow to the origin of winding sections 44 is guided by curved or—not shown—straight, fifth conducting gaps 40, which adjoin the first gaps 6*i* in the cup bottom; FIG. 19. The step-by-step transition from the cup bottom to the cup wall front, which is caused by the radial gap 7*i*, can for a non-depicted valiant also be ramp-shaped as a result of a gap that is inclined relative to the contact axis.

Figure 20:
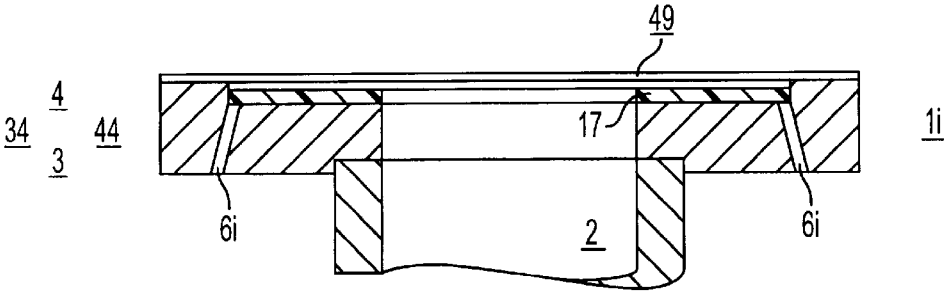
FIG. 20 is a partial sectional view of contact according to FIG. 18, left of center with contact and electrode elements as well as supporting elements.
Figure 18:
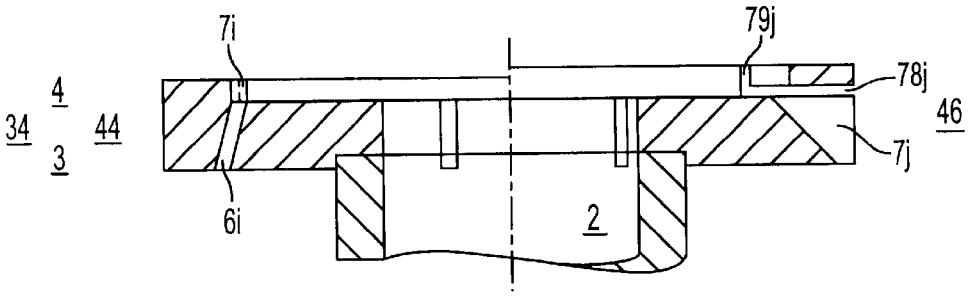
FIG. 18 is a partial sectional view of a contact with contact and electrode element as well as supporting element removed; left of center, cut A-M according to FIG. 19, circular arc shaped gaps or slots in the cup bottom with side surfaces inclined relative to the contact axis; right of center; cut B-M according to FIG. 19; circular arc shaped gaps in the cup bottom with side surface inclined relative to the contact axis, azimuthally adjoining circular gaps in the cup wall.
Figure 23:
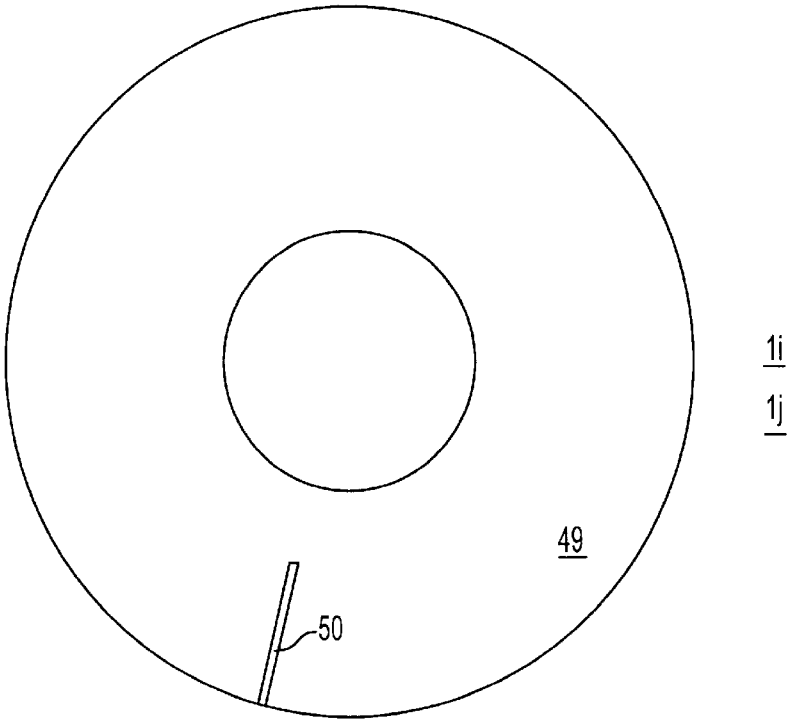
FIG. 23 is a plan view of contact according to FIGS. 21 or 22.
Figure 22:
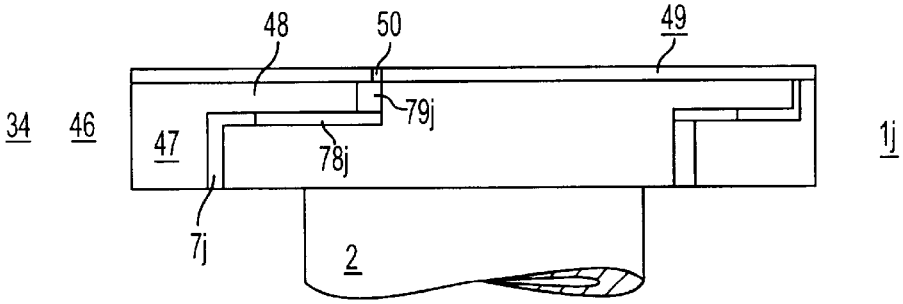
FIG. 22 is a partial elevational view of contact according to FIG. 18; right of center.

Concerning the design or the gap 6*j* as shown in FIG. 19: As a variation, the side peripheral surfaces of the first gap 6*j* that are inclined toward the contact axis are guided with increasing inclination toward the underside of the cup bottom, starting with one of its ends—or thereafter—in such a way that the peripheral surface on the inside maintains a distance to the outer bottom edge, in order to continue with a constant inclination in azimuthal direction, wherein a distance is also maintained to the preceding first gap 6*j*; FIG. 19, right half of view from above. This is adjoined by a second gap 7*j* that does not quite extend to the frontal surface of the cup edge and adjoining this is a third gap 78*j*, shown in FIG. 18, which is guided in the cup wall above the cup bottom, wherein it ends before the preceding gap 6*j*. This is followed by a separating gap 79*j* in a radial cutting plane that extends from the cup bottom to the front of the cup wall; FIG. 18, right half of sectional view; FIG. 19, right half of view from above and FIG. 22. As a result of the first and second gaps 6*j* or 7*j* in the cup bottom, as well as the third and fourth gaps 78*j* or 79*j* in the cup wall, the winding sections 46 with respectively two regions develop; FIG. 19, right half of the view from above; in the adjoining winding region 48, the overlapping is only axial; FIG. 19, right half of view from above and FIG. 22 The preceding region where winding sections 46 exit from cup bottom 3 is respectively overlapped by the following winding sections 46 with the above listed overlapping regions 47 and 48. In the right, lower fourth of the view from above in FIG. 19, the winding section 46 is broken off for the most part so that the inclined, inside peripheral side surface of the first gap 6*j* becomes visible as well as the expansion of the bottom surface to the bottom edge that is caused by the gap 78*j*. The two step-by-step transitions in this region, in connection with the gaps 7*j* and 79*j*, can also have a ramp-like shape, as has already been, explained. A contact and electrode element 49 rests on the frontal surface of the cup wall 4 in FIGS. 17, 20, 23, which can have radial gaps 50—two or one of these arc shown—or may not have any, as is shown with the remaining surface for the contact and electrode element 49. The radial gaps 50 in the contact and electrode element or disk are arranged above the gaps 79, 7*i*, 79*j* in the cup wall, wherein the gaps in the element or disk can be smaller than the gaps in the cup wall, FIGS. 16 to 23

Figure 25:
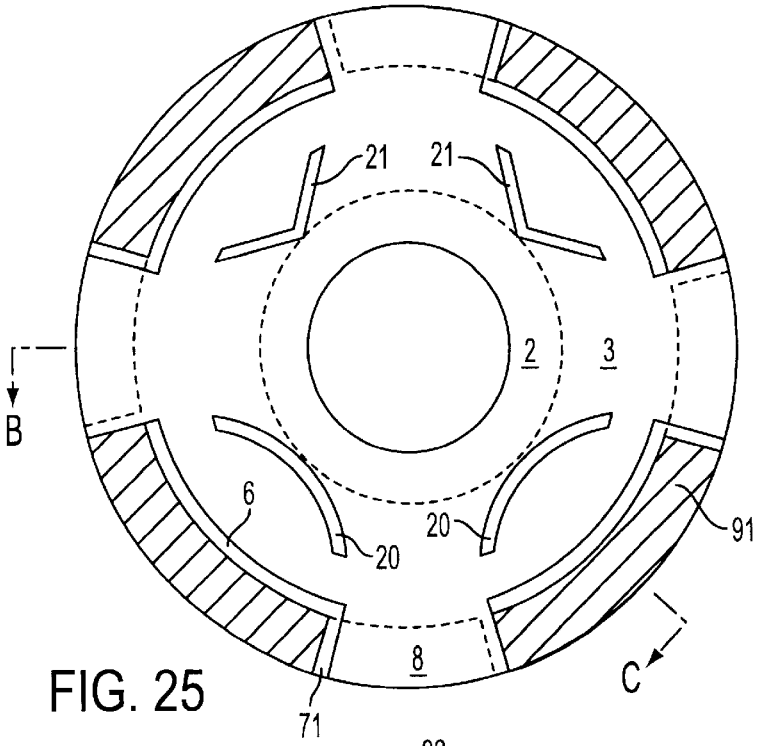
FIG. 25 is a plan view of the contact according to FIG. 24, cut A—A.
Figure 24:
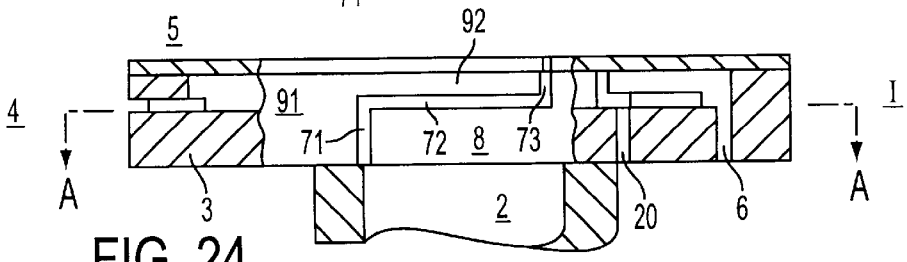
FIG. 24 is a partial, sectional view of a contact with axial overlapping of the bottom projection through the end regions of the winding sections shown in three partial views.

Four, approximately rotation-symmetrically distributed first gaps 6 are arranged in the cup bottom 3 of contact I, along the inside of cup wall 4; FIGS. 24, 25. FIGS. 24, 25 show that the first gaps are adjoined by second gaps 71 that arc guided in a radial plane, which extend axially into the cup wall only far enough so that they can be joined by third gaps 72 that run in the cup wall directly above the cup bottom; FIG. 24. The third gaps 72 extend until the preceding first gaps 6 where they are joined by a fourth gap 73 that extends in a radial plane to the front of the cup wall; FIG. 24. Ring-shaped winding sections 9 are created as a result of the gaps 6, 71, 72, 73. The region 91 of winding sections 9 surrounds the cup bottom peripherally while their region 92 axially overlaps tile bottom projection 8; FIGS. 24, 25. In the region between the bottom projections 8 and the power connector or contact rod 2, gaps are installed in front of the first gaps 6 in the cup bottom 3, to prevent a current flow from the contact rod radially to the first gaps 6 These gaps, which are installed in front, can be embodied in the following variants for example: The gaps 20 are bent to form a circular arc line and are arranged such that the convexity of the circular arc points inward; FIG. 25. Less effective for screening are circular arc gaps—not shown—for which the convexity points outward A radius line through the apex of the convexity represents a symmetrical axis, at least for a partial region of the gap 20. The gaps 21 that are installed in front have an angle shape with the opening facing the first gaps 6; FIG. 25. A radius line through the angle point represents a symmetrical axis, at least for a partial region of the angle legs. In place of curved or angle-shaped screening gaps 20 or 21, it is also possible to use gaps—not shown—that extend along a straight line and are positioned in the bottom region in front of the first gap 6, between two projections 8 and the power connector or contact rod 2.

Figure 26:
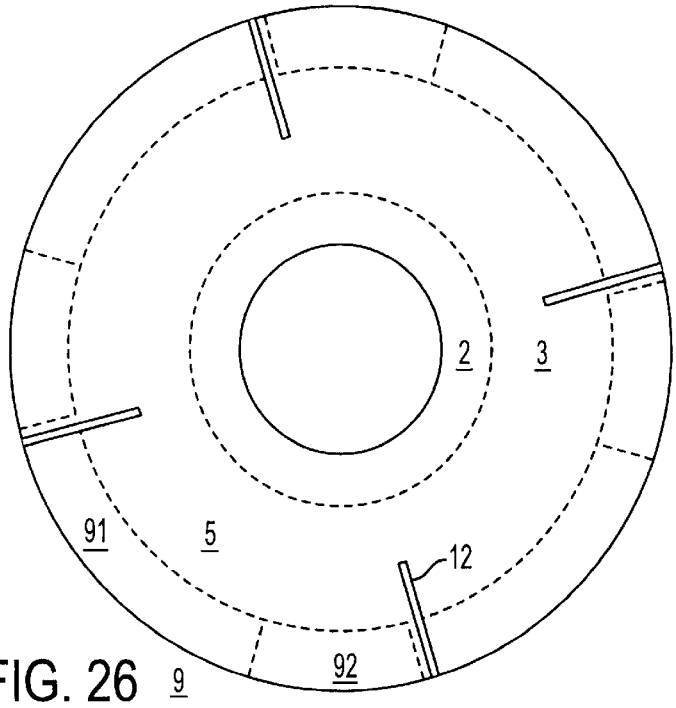
FIG. 26 is a plan view of the contact according to FIG. 24, uncut.

A contact and electrode disk or element 5 is positioned on the free front of the cup wall 4 in FIG. 26, which is supported by an element—not shown—that is essentially disk-shaped and composed of a material with poor electrical conductivity or of an insulating material. Between the gap 71 that radially adjoins lie first gap 6 and thc preceding first gap 6, there is a projection 8 in the cup bottom, which is joined by a winding section 9 on one side. The maximum azimuthal extension of the bottom projection 8 is approximately three times that of the radial extension of the adjoining winding section 9 so that a sufficiently high azimuthal flow component can form in the bottom projection for the flow against this winding section from the cup bottom.

Figure 29:
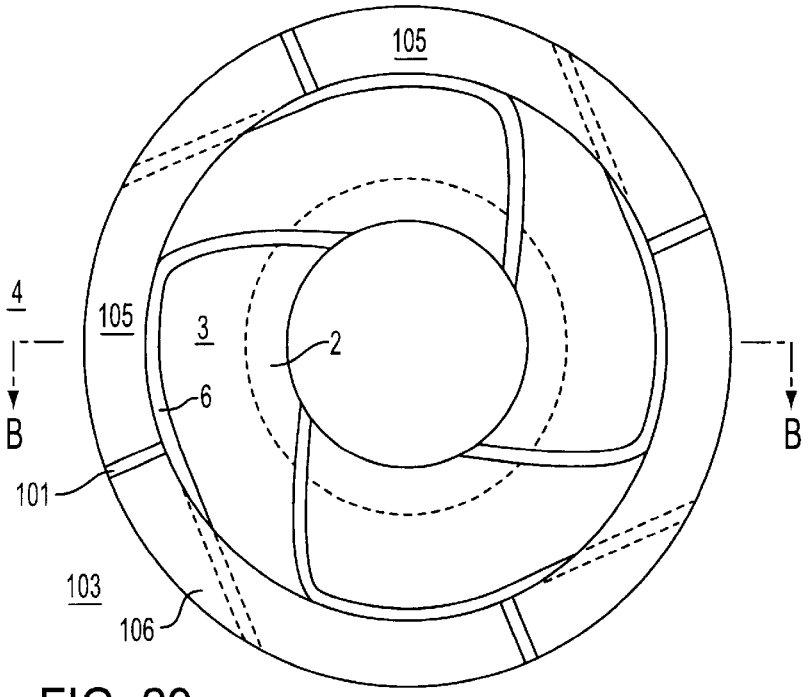
FIG. 29 is a plan view of the contact according to FIG. 27.
Figure 28:
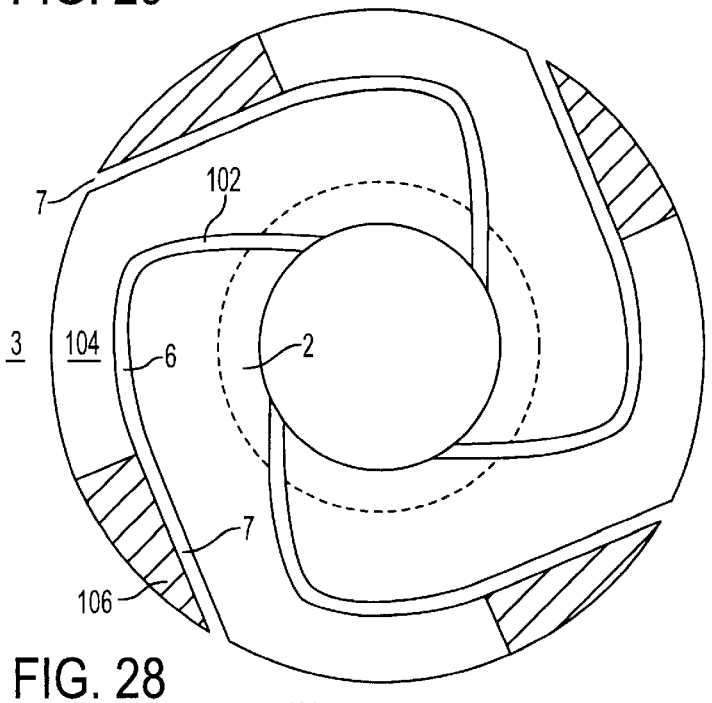
FIG. 28 is a plan view of section A—A of the contact according to FIG. 27.
Figure 27:
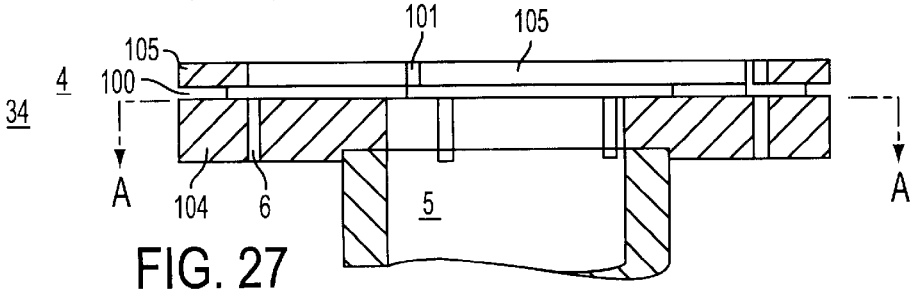
FIG. 27 is a partial longitudinal sectional view B—B of contact according to FIG. 29; circular gap in the cup bottom with side peripheral surfaces parallel to the contact axis.

The cup-shaped support 2 that has a hollow-cylinder shape at least in the connecting or contact rod region. A gap 6 runs along the inside of cup wall 4 in cup bottom 3; FIGS. 27, 28, 29 Adjoining one of its ends, in the direction toward the power connector or contact rod 2 and intersecting its wall in the frontal region, is a curved gap 102, which can also be designed with a straight line. In another design variant that is not shown, this gap 102 is arranged only in the frontal region of the power connector.

Figure 32:
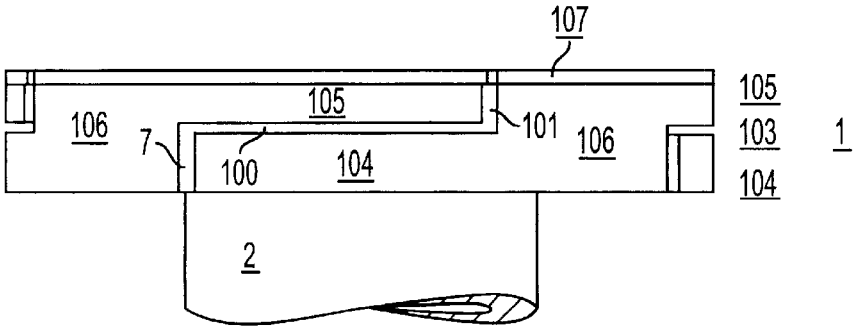
FIG. 32 is a partial elevational view of the contact according to FIG. 30.

A second gap 7 adjoins approximately tangential the other end of gap 6 in the cup bottom 3, which extends to the outer circumference of the cup bottom; FIG. 28. On the outside the gap 7 is adjoined by a third gap 100 that runs in the cup wall 4, immediately above the cup bottom 3, which extends to the outer circumference and then runs in circumferential direction up to about the end region of the preceding first gap 6; FIGS. 27, 28. A fourth gap 101 adjoins there, which appears on the front of the cup wall, along a radius line; FIGS. 29, 32. In the drawings, the gap 101 is guided along a plane that is parallel to the contact as, so that a step-by-step transition from the cup bottom 3 to the front of the cup wall 4 results; FIG. 32. In a design variant that is not depicted here, this transition can also be designed as a ramp, meaning inclined toward the contact axis. This also results in an overlapping of the end region of a winding section 103. This systematic succession of the gaps 6, 7 in the bottom 3 and gaps 100, 101 in the wall 4 of the cup 34 results in a winding section 103 with two regions: The sectional region 104 runs in the bottom, the sectional region 105 in the wall, as shown in FIGS. 27, 32, and the gap 102 causes the flowing against the sectional region 104 with an azimuthal flow component already; FIG. 28. The transition region 106 is located between the sectional regions 104 and 105 of a winding section 103. The cross section of the wall region 105 of the winding regions 103 must not be smaller than about 25% of the cross section of the bottom region 104. It can be advantageous if the cross section of the wall region 105 is at least as large as the cross section of the bottom region 104.

The cup-shaped support 34 comprises four such winding sections 103, which are electrically connected in parallel. In this case, the wall region 105 of a winding section 103 respectively overlaps the bottom region 104 of a preceding winding section 103; FIG. 32. The degree of overlapping depends on the selection of the location for the gap 101 and can thus be adjusted. As a whole, the four regions of the four winding sections 103 that each occupy one plane in the wall and bottom of the cup result in a relatively close approximation of two full-circle windings on each contact. One fourth of the total current for the contact arrangement flows through each one. As a result, a magnetic field generating ting current with a maximum value equal to half the nominal short-circuit cutoff current for the contact arrangement flows along the circumferential region of the cup 34.

Figure 31:
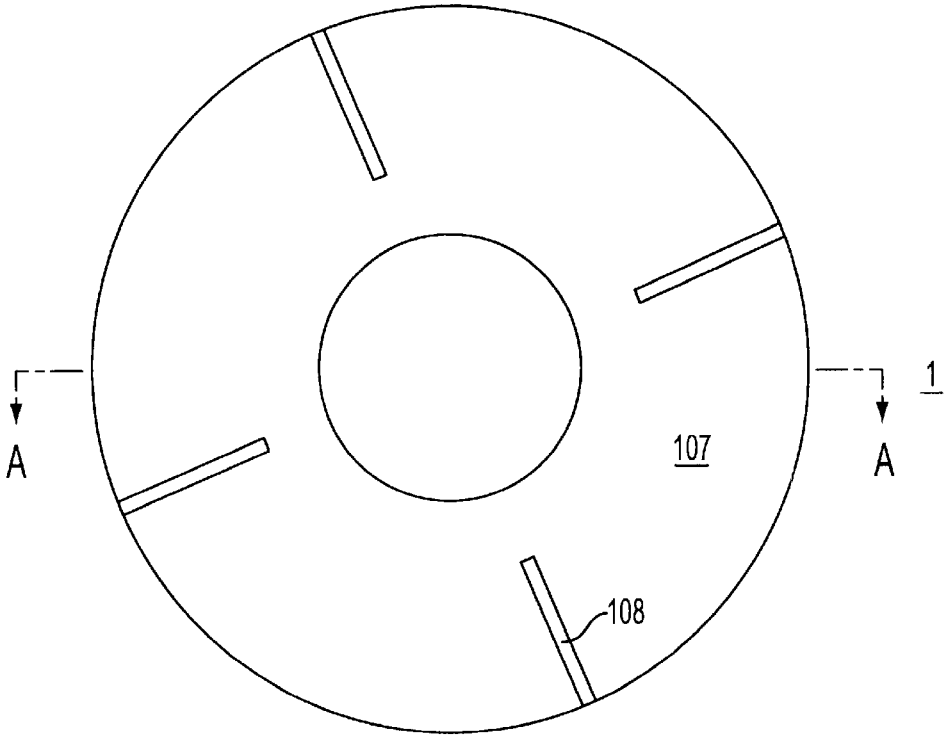
FIG. 31 is a plan view of the contact according to FIG. 30.
Figure 30:
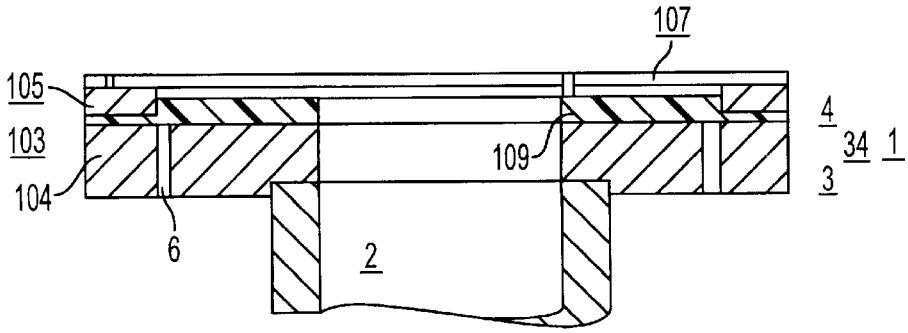
FIG. 30 is a partial longitudinal sectional view of a contact according to FIG. 32 with contact and support element.

The contact and electrode element or disk 107 rests against the front of the cup wall 4;

FIGS. 30, 31, 32. It is designed as a circular disk and has radial gaps 108 for damping the eddy currents. The metallic material for the contact and electrode disk 107 has at least in part a smaller electrical conductivity, as compared to copper, which has a high electrical conductivity.

Figure 33:
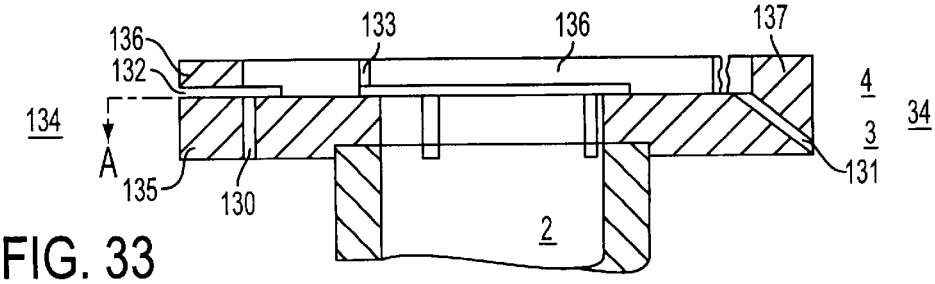
FIG. 33 is a partial longitudinal sectional view B—B of a contact according to FIG. 35; circular gap in the cup bottom with side peripheral surfaces inclined toward the contact axis.

A high share of chromium can be of advantage for this purpose, e.g., chromium/copper at a ratio of at least 75/25. The radial gaps in the contact and electrode disk may not be necessary in this case. It can also be an advantage to show the contact and electrode disk as separate, generally segment-shaped elements. As support for the contact and electrode disk 107 serves a generally disk-shaped element 109, which also supports the wall region 105 of the winding sections 103; FIG. 33. This supporting element may be composed of a ceramic material, for which the mechanical stability is reinforced by inserted fiber materials that are not shown. The supporting element 109 can also be produced from a steel alloy, e.g., non-rusting steel, which has considerably lower, specific electrical conductivity relative to copper.

Figure 35:
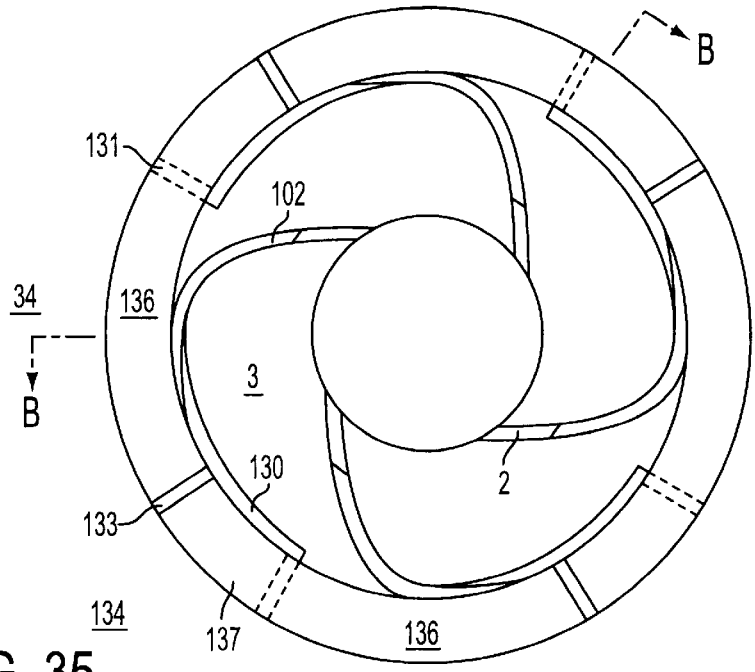
FIG. 35 is a plan view of the contact according to FIG. 33.
Figure 34:
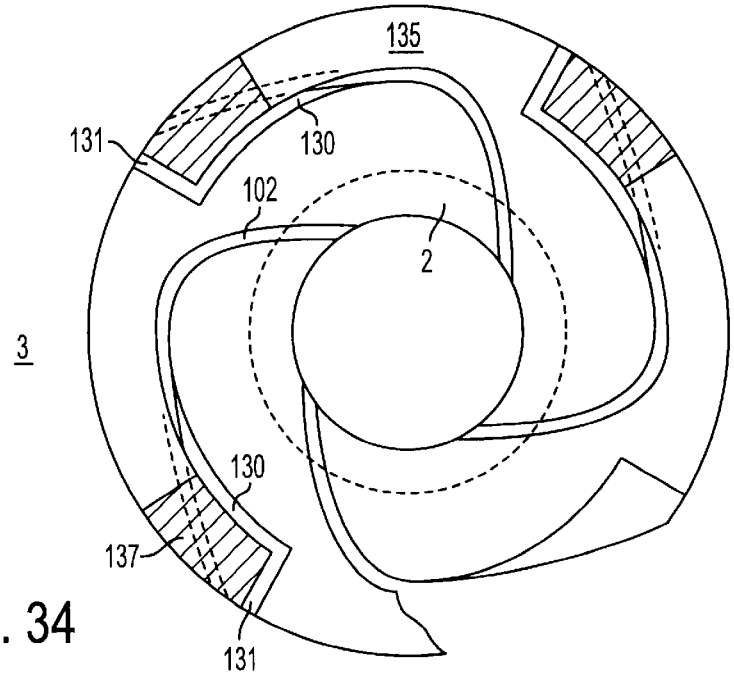
FIG. 34 is a plan view of cut A—A of the contact according to FIG. 33.
Figure 37:
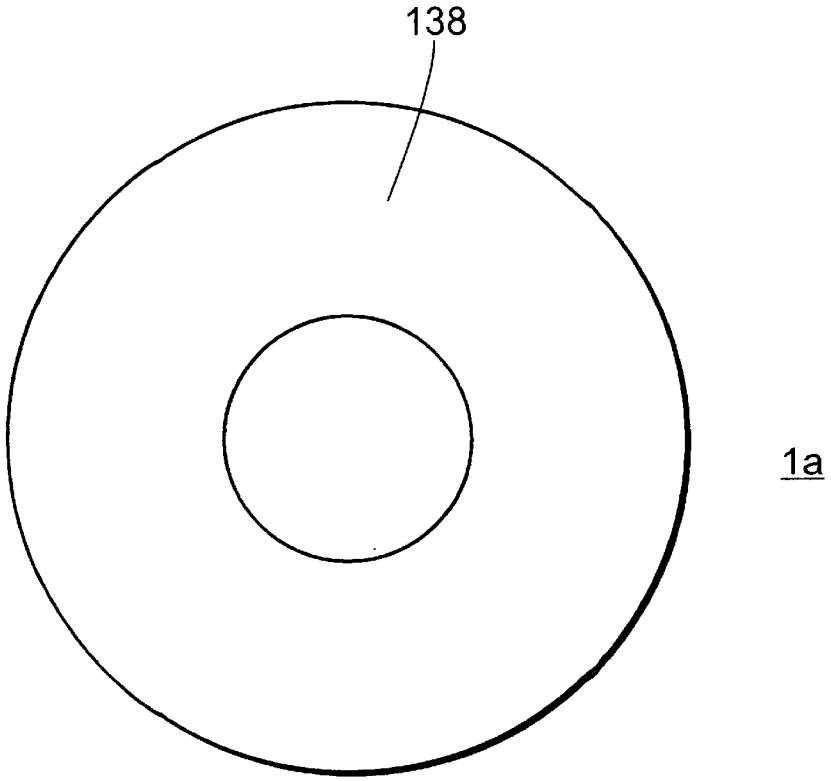
FIG. 37 is a plan view of the contact according to FIG. 36.
Figure 36:
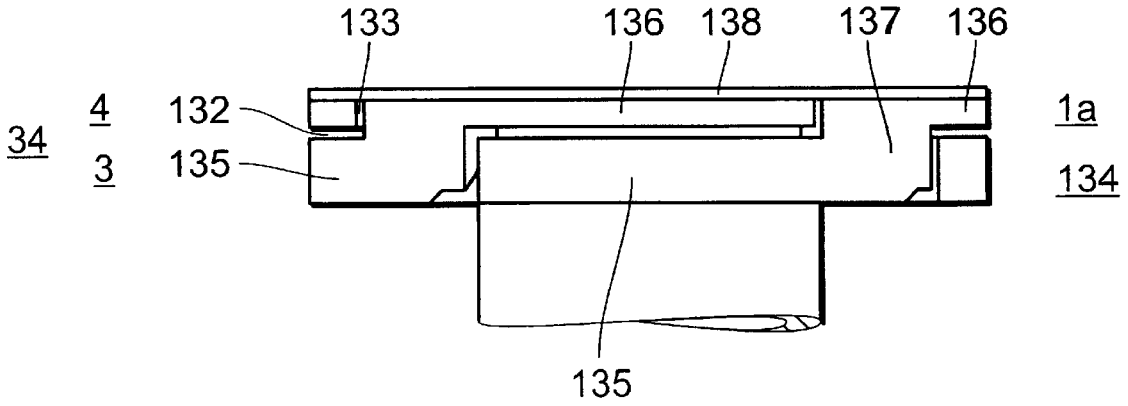
FIG. 36 is a partial elevational view of the contact according to FIG. 33, with contact disk.

A peripheral as well as an axial overlapping of the transition region 137 of a winding section 134 and the region where a preceding winding section 134 exits the bottom 3 is shown in the following exemplary embodiment; FIGS. 33, 34, 35. For this purpose, the first gap 130 is limited by walls on the side, at least along a portion of its length, which are inclined outward relative to the contact axis. This inclination of the gap walls along the gap 130 increases until the outside of the cup bottom 3 is reached and subsequently remains constant; FIG. 34. This second gap 131 runs on the inside along the inside-slanted wall for the first gap 130 and continues in the direction toward the outer circumference of the cup bottom 3, essentially along a radius line. The transition to the preceding region where the winding section 134 exits the cup bottom therefore occurs in a stage with triangular pro-file; FIG. 34. In a design variant that is not shown here, this transition via a gap guided along an inclined plane can also have a ramp-shaped design. An adjoining third gap 132 that runs in the cup wall above the cup bottom 3 creates the wall region 136 for the winding section 134; FIGS. 33, 36. The complete separation of the ends of the winding regions 136 from the cup wall 4 creates a fourth gap 133; FIGS. 33, 36. This separating gap as well runs along a radial plane. Guiding the separation gap 133 along a plane that is inclined toward the contact axis permits a ramp-shaped transition, which is not shown however. The contact and electrode disk 138, shown in FIG. 37, which is designed as a circular disk without gap, is positioned on the front surface of the wall region 136 of winding sections 134; FIG. 36. With respect to other possible embodiments of the contact and electrode element 138 and the material used for this, we want to point out the description of the contact and electrode element 107; FIGS. 30, 31. The same applies for the supporting element which is not shown.

I claim:

1. A vacuum circuit-breaker contact arrangement comprising a pair of contacts with a contact pin being relatively axially moveable to one another from a position of engagement to a position of disengagement to establish a circuit interrupting arc therebetween, at least one of said contacts being provided with a generally cup shaped member having a bottom plate connected with said contact pin and a wall portion, a plurality of slots which produce winding sections being arranged in said cup shaped member, the inside of said cup shaped member being at least partly covered by a contact- and electrode-member at a front side of said cup shaped member and facing said other contact, said other contact having a contact- and electrode-member generally aligned with the contact- and electrode-member of said at least one contact, wherein said plurality of slots includes at least one first slot and a second slot, the bottom plate of at least one contact being provided with said at least one first slot which essentially extends inside said wall portion along an arc of a circle and penetrates at least partly the bottom plate away from said contact- and electrode-member, said second slot being joined to an end of said first slot and extending at least into the wall portion of said cup shaped member toward said contact- and electrode-member, so that radially outside of said first slot is produced at least one winding section, said at least one winding section generating essentially axial magnetic field in a current conducting state.

2. A contact arrangement according to claim 1 wherein said second slot is joined to the first slot in the bottom plate of the cup shaped member, said second slot deviating not more than ninety annular degrees from a tangent to said first slot, and said plurality of slots further includes third and fourth slots, said third slot is joined to said second slot and extends in the wall portion toward a preceding first slot, said fourth slot is joined to said third slot and extends toward an end face of the wall portion facing said other contact.

3. A contact arrangement according to claim 1 wherein both of the pair of contacts have the structure of said at least one contact and the winding sections produced by said plurality of slots follow each other in the same order of turn thereby generating in the current carrying state an essentially axial magnetic field.

4. A vacuum circuit-breaker contact arrangement comprising a pair of contacts with a contact pin being relatively axially moveable to one another from a position of engagement to a position of disengagement to establish a circuit interrupting arc therebetween, at least one of said contacts being provided with a generally cup shaped member having a bottom plate connected with said contact pin and a wall portion, a plurality of slots which produce winding sections being disposed in said cup shaped member, the inside of said cup shaped member being at least partially covered by a contact- and electrode-member mounted at a front side of said cup shaped member facing said other contact, said other contact having a contact- and electrode-member being generally aligned with the contact- and electrode-member of said first contact, wherein said plurality of slots includes at least one first slot, a second slot, a third slot and a fourth slot, the bottom plate is provided with said at least one first slot at least at the inside of said bottom plate extending in a circumferential direction, said at least one first slot extends to join said second slot which extends at least in the direction of the periphery of said bottom plate, said third slot joins said second slot and extends peripherally in the wall portion above the bottom plate, said third slot having a larger radius than said first slot, said fourth slot joins said third slot and extends toward an end face of said wall portion facing said other contact.

5. A contact arrangement according to claim 4 wherein both of the pair of contacts have the structure of said at least one contact and the winding sections produced by said plurality of slots follow each other in the same order of turn thereby generating in the current carrying state an essentially axial magnetic field.

* * * * *